US008936356B2

(12) United States Patent
Yoshida

(10) Patent No.: US 8,936,356 B2
(45) Date of Patent: Jan. 20, 2015

(54) PRINTING APPARATUS AND METHOD OF SUPPRESSING RISE OF TEMPERATURE OF INK STORAGE UNIT

(71) Applicant: Seiko Epson Corporation, Tokyo (JP)

(72) Inventor: Yuji Yoshida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/753,148

(22) Filed: Jan. 29, 2013

(65) Prior Publication Data

US 2013/0201242 A1 Aug. 8, 2013

(30) Foreign Application Priority Data

Feb. 2, 2012 (JP) ..... 2012-021189

(51) Int. Cl.

| | |
|---|---|
| ***B41J 2/185*** | (2006.01) |
| ***B41J 2/17*** | (2006.01) |
| ***B41J 29/38*** | (2006.01) |
| ***B41J 29/377*** | (2006.01) |
| ***B41J 2/18*** | (2006.01) |

(52) U.S. Cl.

CPC . *B41J 29/377* (2013.01); *B41J 2/18* (2013.01)

USPC ..... 347/89; 347/84; 347/6

(58) Field of Classification Search

CPC ..... B41J 2/04563; B41J 2/3358; B41J 2/365; B41J 2/1408; B41J 2202/08

See application file for complete search history.

(56) References Cited

U.S. PATENT DOCUMENTS

| | | | | |
|---|---|---|---|---|
| 6,607,259 | B2 * | 8/2003 | Mott et al. | 347/18 |
| 7,380,927 | B2 * | 6/2008 | Shigemura | 347/89 |
| 2006/0209140 | A1 | 9/2006 | Nagai | |

FOREIGN PATENT DOCUMENTS

| | | |
|---|---|---|
| JP | 2006-289955 | 10/2006 |

* cited by examiner

*Primary Examiner* — Stephen Meier
*Assistant Examiner* — Renee I Wilson
(74) *Attorney, Agent, or Firm* — Workman Nydegger

(57) ABSTRACT

A printing apparatus includes an ink storage unit; a print head unit which has an ink reception port, an ink discharging device, and an ink exhaust port; an ink return path which is connected to the ink exhaust port and which returns ink exhausted from the ink exhaust port to the ink storage unit; and a cooling device which is arranged in the ink return path and which cools ink which passes through the ink return path.

11 Claims, 10 Drawing Sheets

SECOND EMBODIMENT

SECOND EMBODIMENT

THIRD EMBODIMENT

FOURTH EMBODIMENT

FOURTH EMBODIMENT

FIFTH EMBODIMENT

SIXTH EMBODIMENT

SEVENTH EMBODIMENT

PRINTING APPARATUS AND METHOD OF SUPPRESSING RISE OF TEMPERATURE OF INK STORAGE UNIT

BACKGROUND

1. Technical Field

The present invention relates to the cooling of an ink storage unit which supplies ink to a printing apparatus.

2. Related Art

In the related art, as an ink jet-type printer, a technology has been proposed that includes a print head unit which has an ink discharging device (the piezoelectric element of a piezoelectric-type printer or the heater of a thermal-type printer), and an ink circulation path which is connected to an ink tank, thereby circulating ink (refer to JP-A-2006-289955). In the ink jet-type printer, since the load of the ink discharging device or the load of the control circuit of the ink discharging device increases along with improvements in print speed or print resolution, the temperature of the ink discharging device or the control circuit rises, and thus the temperature of the print head unit becomes high.

In the above-described technology that circulates ink, when the temperature of the print head unit is high because high-speed printing or high-resolution printing is performed, the temperature of ink rises while ink passes through the print head unit, thus high temperature ink is supplied (returned) to the ink tank. Therefore, since the temperature of the ink tank itself is unusually high, high heat resistance is required for the base material of the ink tank, and thus there is a problem in that the manufacturing cost of the ink tank is expensive. In addition, since ink, the temperature of which is high, is supplied to the ink tank, the temperature of ink which is stored in the ink tank in advance rises, and thus there is a problem in that the physical properties of ink vary.

Meanwhile, such a problem is not limited to a configuration which circulates ink supplied from the ink tank, and is common to a configuration which circulates ink supplied from an arbitrary ink storage unit, such as ink cartridges, which stores ink. In addition, such a program is not limited to the ink jet-type printer, and is common to an arbitrary printing apparatus which includes a print head unit, the temperature of which rises along with an ink discharging operation.

SUMMARY

An advantage of some aspects of the invention is to suppress a rise in the temperature of an ink storage unit in a printing apparatus which uses the ink supplied from the ink storage unit by circulating the ink.

The invention can be realized in the following forms or application examples.

Application Example 1

According to Application Example 1, there is provided a printing apparatus including: an ink storage unit; a print head unit that includes an ink reception port which receives ink supplied from the ink storage unit, an ink discharging device which performs ink discharge on a printing medium using the supplied ink, and an ink exhaust port which exhausts ink which is not used for the ink discharge among the supplied ink; an ink return path that is connected to the ink exhaust port, and returns the ink which is exhausted from the ink exhaust port to the ink storage unit; and a cooling device that is arranged in the ink return path, and cools ink which passes through the ink return path.

According to the printing apparatus of Application Example 1, since ink which is discharged from the print head unit is cooled by the cooling device and then returns to the ink storage unit, it is possible to suppress a rise in the temperature of ink in the ink storage unit. Therefore, since it is possible to suppress a rise in the temperature of the ink storage unit, to use various types of materials as the base material of the ink storage unit regardless of heat resistance and to restrain the manufacturing cost of the ink storage unit. In addition, since it is possible to suppress a rise in the temperature of the ink storage unit, and suppress the variation in the physical properties of ink in the ink storage unit. In addition, in the printing apparatus of Application Example 1, since the cooling device is arranged in the ink return path, it is possible to return the ink, which is discharged from the print head unit in the cooling device, to the print head unit after cooling the ink. Therefore, even when the ink discharging device performs the ink discharge at a high speed in order to, for example, implement high-speed printing or high-resolution printing and thus the temperature of the ink discharging device is high, it is possible to suppress a rise in the temperature of the print head unit using the cooled ink which is supplied to the print head unit. Therefore, it is possible to suppress a rise in the temperature of the printing apparatus along with the rise in the temperature of the print head unit. In addition, since the ink which is supplied from the ink storage unit is used as a cooling medium, it is possible to suppress the manufacturing cost of the printing apparatus, compared to a configuration which uses a cooling medium that is different from ink.

Application Example 2

The printing apparatus according to Application Example 1 may further include an installation unit that enables an ink cartridge to be detachably installed, and the ink storage unit may include the ink cartridge which is installed in the installation unit.

According to such a configuration, it is possible to supply ink to the print head unit by installing the ink cartridge in the printing apparatus.

Application Example 3

The printing apparatus according to Application Example 1 or Application Example 2 may further include a cooling controller that controls a degree of cooling of ink of the cooling device.

According to such a configuration, it is possible to control the degree of cooling of ink depending on the operational situation of the printing apparatus or environmental variation. Therefore, even when an operational situation or environmental variation which causes the temperature of the printing apparatus to be high is generated, it is possible to perform control such that the degree of cooling of ink of the cooling device increases depending on the variation.

Application Example 4

The printing apparatus according to Application Example 3 may further include a speed setting value acquisition unit that acquires a setting value of a print speed of the printing apparatus, and the cooling controller may control the degree of cooling of the ink of the cooling device depending on the print speed which is indicated by the acquired setting value.

According to such a configuration, it is possible to control the degree of cooling of ink depending on the print speed of the printing apparatus. Therefore, for example, when an ink discharging operation is performed at a high speed and the temperature of the ink discharging device is high because the print speed is a high speed, it is possible to restrain the rise in the temperature of the print head unit by increasing the degree of cooling of ink. In addition, for example, when the ink discharging operation is performed at a low speed and the temperature of the ink discharging device is not high because the print speed is low, it is possible to restrain the operation of the cooling device by lowering the degree of cooling of ink, to suppress the amount of electric power of the cooling device, and to suppress the deterioration of the cooling device.

Application Example 5

In the printing apparatus according to the Application Example 4, the cooling controller may perform control such that the degree of cooling in a case in which the print speed is higher than a predetermined speed is higher than a degree of cooling in a case in which the print speed is equal to or lower than the predetermined speed.

According to such a configuration, when the temperature of the ink discharging device may be high because the print speed is higher than the predetermined speed and the ink discharging operation is performed at a high speed, it is possible to restrain the rise in the temperature of the print head unit by causing the degree of cooling of ink to be high.

Application Example 6

The printing apparatus according to Application Example 3 may further include a resolution setting value acquisition unit that acquires a setting value of a print resolution of the printing apparatus, and the cooling controller may control the degree of cooling of the ink of the cooling device depending on the print resolution which is indicated by the acquired setting value.

According to such a configuration, it is possible to control the degree of cooling of ink depending on the print resolution of the printing apparatus. Therefore, for example, when the ink discharging operation is performed at a high speed and the temperature of the ink discharging device becomes high because the print resolution is high, it is possible to restrain the rise in the temperature of the print head unit by increasing the degree of cooling of ink. In addition, for example, when the ink discharging operation is performed at a low speed and the temperature of the ink discharging device does not become high because the print resolution is low, it is possible to restrain the operation of the cooling device by lowering the degree of cooling of ink, to suppress the amount of electric power of the cooling device, and to suppress the deterioration of the cooling device.

Application Example 7

In the printing apparatus according to Application Example 6, the cooling controller may perform control such that the degree of cooling in a case in which the print resolution is higher than a predetermined resolution is higher than the degree of cooling in a case in which the print resolution is equal to or lower than the predetermined resolution.

According to such a configuration, when the temperature of the ink discharging device may be high because the print resolution is higher than the predetermined resolution and the ink discharging operation is performed at a high speed, it is possible to restrain the rise in the temperature of the print head unit by increasing the degree of cooling of ink.

Application Example 8

The printing apparatus according to Application Example 3 may further include a temperature measurement unit that measures a temperature of the printing apparatus, and the cooling controller may control the degree of cooling of the ink of the cooling device depending on the measured temperature.

According to such a configuration, it is possible to control the degree of cooling of ink depending on the temperature of the printing apparatus. Therefore, for example, when the temperature of the ink discharging device rises because the ink discharging operation is performed at a high speed in order to implement high-speed printing or high-resolution printing and thus the temperature of the printing apparatus may be high, it is possible to restrain the rise in the temperature of the print head unit by increasing the degree of cooling of ink. In addition, for example, when the temperature of the ink discharging device is not high because the ink discharging operation is performed at a low speed in order to implement low-speed printing or low-resolution printing and thus the temperature of the printing apparatus is not high, it is possible to restrain the operation of the cooling device by lowering the degree of cooling of ink, to suppress the amount of electric power of the cooling device, and to suppress the deterioration of the cooling device.

Application Example 9

In the printing apparatus according to Application Example 8, the cooling controller may perform control such that the degree of cooling in a case in which the temperature is higher than a predetermined temperature is higher than the degree of cooling in a case in which the temperature is equal to or lower than the predetermined temperature.

According to such a configuration, when the temperature of the ink discharging device is high because the ink discharging operation is performed at a high speed in order to implement high-speed printing or high-resolution printing, it is possible to restrain the rise in the temperature of the print head unit by increasing the degree of cooling of ink.

Application Example 10

In the printing apparatus according to any one of Application Example 3 to Application Example 9, the degree of cooling may relate to electric power which is supplied to the cooling device, and the cooling controller may perform control such that the degree of cooling increases by increasing the amount of electric power.

According to such a configuration, it is possible to perform control such that the degree of cooling easily increases by increasing the amount of electric power which is supplied to the cooling device.

Application Example 11

According to Application Example 11, there is provided a method of suppressing a rise in temperature of an ink storage unit in a printing apparatus that includes the ink storage unit, a print head unit which has an ink reception port, an ink exhaust port, and an ink discharging device performing ink discharge on a printing medium, and an ink return path which connects the ink exhaust port with the ink storage unit, the method including: (a) receiving the ink, which is supplied from the ink storage unit, from the ink reception port in the print head unit; (b) exhausting ink, which is not used for the ink discharge among the supplied ink, from the ink exhaust port to the ink return path in the print head unit; (c) cooling the ink which is exhausted to the ink return path using a cooling device which is arranged in the ink return path; and (d) returning the cooled ink to the ink storage unit using the ink return path.

In the method according to Application Example 11, since ink which is discharged from the print head unit is cooled in the cooling device and then returns to the ink storage unit, it is possible to suppress a rise in the temperature of ink in the ink storage unit. Therefore, since it is possible to suppress a rise in the temperature of the ink storage unit, it is possible to use various types of materials as the base material of the ink storage unit regardless of heat resistance, and to restrain the manufacturing cost of the ink storage unit. In addition, since it is possible to suppress a rise in the temperature of the ink storage unit, it is possible to suppress the variation in the physical properties of ink in the ink storage unit. In addition, in the method according to Application Example 11, it is possible to return ink, which is discharged from the print head unit, to the print head unit via the ink return path and the ink storage unit after cooling the ink in the cooling device. Therefore, for example, even when the ink discharging device performs ink discharge at a high speed in order to implement high-speed printing or high-resolution printing and thus the temperature thereof is high, it is possible to suppress a rise in the temperature of the print head unit using cooled ink which is supplied to the print head unit. Therefore, it is possible to suppress a rise in the temperature of the printing apparatus along with the rise in the temperature of the print head unit. In addition, since ink which is supplied from the ink storage unit is used as the cooling medium, it is possible to restrain the manufacturing cost of the printing apparatus, compared to a configuration which uses a cooling medium that is different from ink.

Meanwhile, the invention can be implemented using various forms. For example, the invention can be implemented using a form such as an ink circulation system, a cooling device control method, a computer program which is used to implement the system or method, or a recording medium which stores the computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A1. Apparatus Configuration

Figure 1:
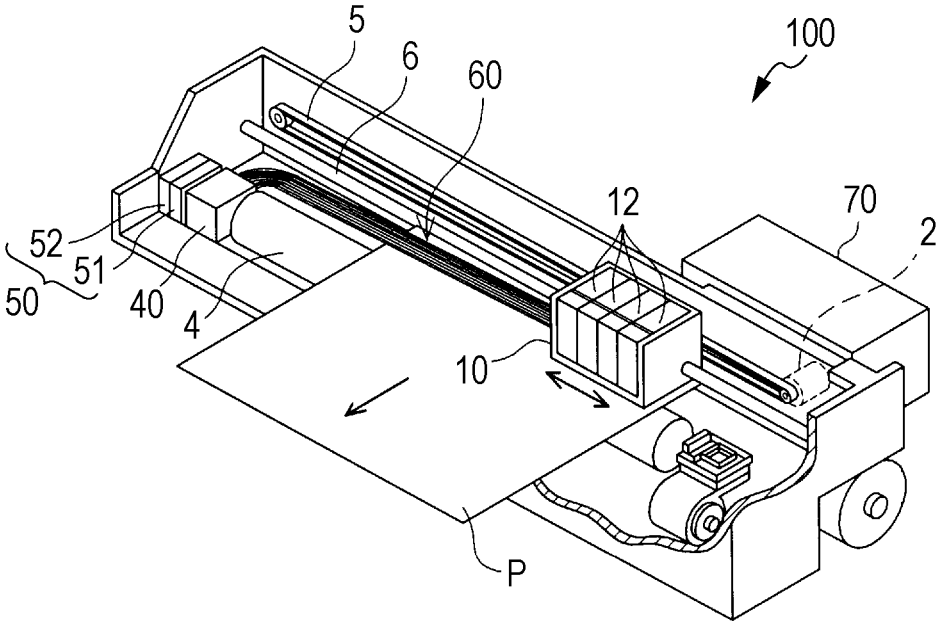
FIG. 1 is a perspective view illustrating the brief configuration of a printing apparatus as a first embodiment of the invention.

FIG. 1 is a perspective view illustrating the brief configuration of a printing apparatus as a first embodiment of the invention. A printing apparatus 100 is a so-called on-carriage type ink jet-type printer, and includes a carriage 10, a drive belt 5, a carriage motor 2, a guide member 6, a paper feed roller 4, an ink circulation tube bundle 60, a pump 40, a cooling device 50, and a main control circuit 70.

The carriage 10 is connected to the drive belt 5, and can reciprocate along the guide member 6 along with the drive of the drive belt 5. The carriage 10 is electrically connected to the main control circuit 70 via a flexible cable which is not shown in the drawing. The carriage 10 includes an ink cartridge installation unit which is not shown in the drawing, and the ink cartridge can be detachably installed in the ink cartridge installation unit. As shown in FIG. 1, four ink cartridges 12 are installed in the carriage 10 in the embodiment.

It is possible to use four ink cartridges each having a single color as the four ink cartridges 12, for example, cyan (C), magenta (M), yellow (Y), and black (K). A user can install the ink cartridges 12 which are filled with ink on the carriage 10 in advance. In addition, when ink is exhausted, the user can detach the ink cartridges 12 from the carriage 10 and install new ink cartridges 12 on the carriage 10.

The drive belt 5 is a circular belt and built on a pair of pulleys. The carriage motor 2 is connected to one side pulley on which the drive belt 5 is built. In addition, the carriage motor 2 is electrically connected to the main control circuit 70. The carriage motor 2 drives the drive belt 5 by rotating the pulleys based on a drive signal which is output from the main control circuit 70. The guide member 6 supports the carriage 10 such that the carriage 10 moves in a predetermined direction (a main scanning direction). The paper feed roller 4 is rotationally driven by power supplied from a paper feed motor which is not shown in the drawing, and transports a printing paper P to a direction which is perpendicular to the main scanning direction (a sub scanning direction).

The ink circulation tube bundle 60 forms an ink circulation path which connects between the ink cartridge 12 and the pump 40 and an ink circulation path which connects between the ink cartridge 12 and the cooling device 50. The pump 40 is arranged in the ink circulation tube bundle 60 (a second ink circulation path 61 which will be described later). The main control circuit 70 controls the entire printing apparatus 100. Meanwhile, the details of the ink circulation tube bundle 60, the pump 40, and the main control circuit 70 will be described later.

Figure 2:
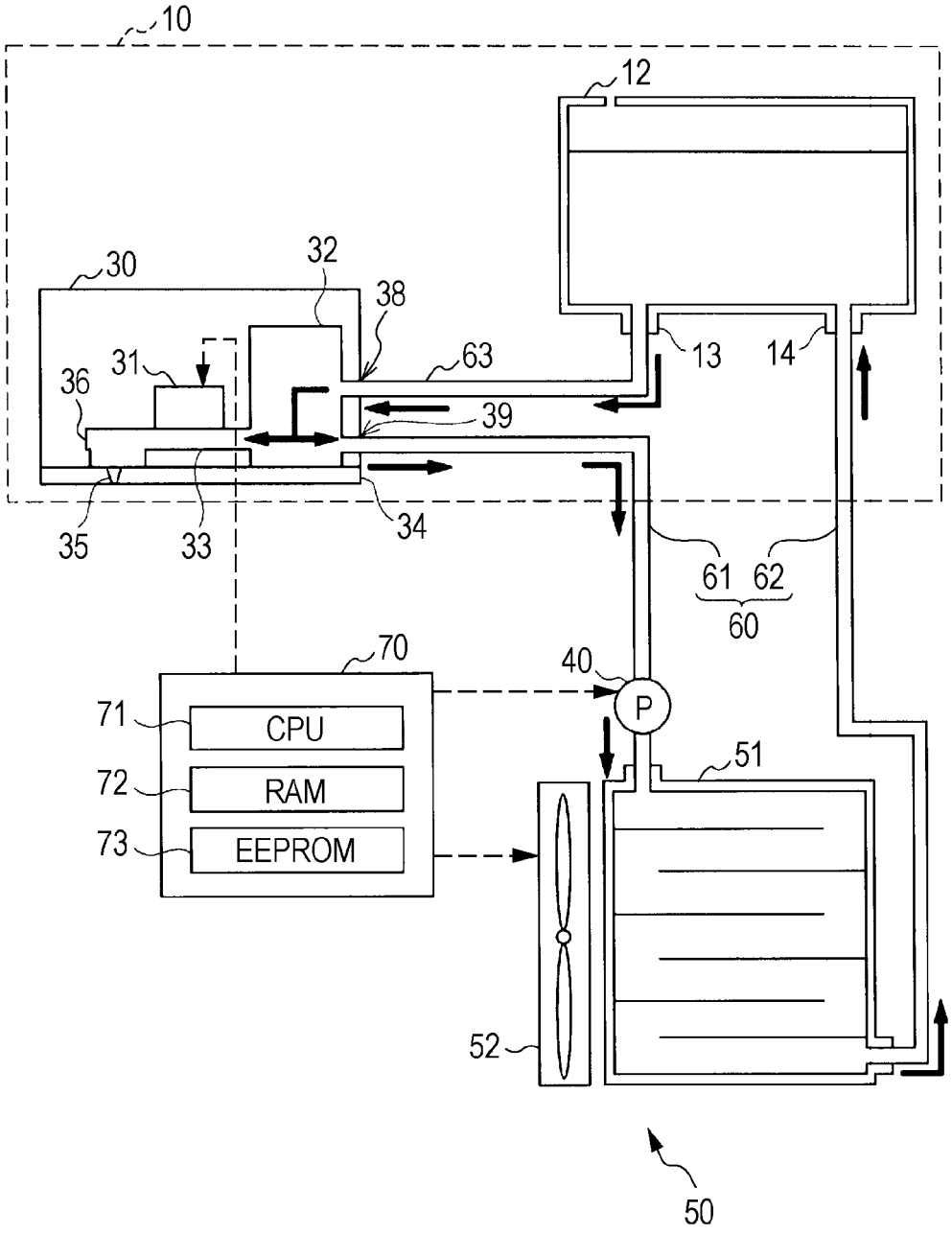
FIG. 2 is an explanatory view schematically illustrating the ink circulation path of the printing apparatus shown in FIG. 1.

FIG. 2 is an explanatory view schematically illustrating the ink circulation path of the printing apparatus shown in FIG. 1. As shown in FIG. 2, the carriage 10 includes a first ink circulation path 63 and a print head unit 30 in addition to the installed four ink cartridges 12. Although FIG. 2 shows a configuration corresponding to a single ink cartridge 12 for convenience of illustration, the printing apparatus 100 has the same configuration as in FIG. 2 for each of the remaining three ink cartridges 12 excepting the print head unit 30, the main control circuit 70, and a fan 52.

Each of the ink cartridges 12 includes a first ink circulation port 13 and a second ink circulation port 14. The first ink circulation port 13 is connected to the first ink circulation path 63. In this embodiment, the first ink circulation port 13 is used as the ink exhaust port of the ink cartridge 12. The second ink circulation port 14 is connected to a third ink circulation path 62 which will be described later. In this embodiment, the second ink circulation port 14 is used as the ink supply port of the ink cartridge 12.

In this embodiment, the first ink circulation path 63 is used as an ink supply path from the ink cartridge 12 to the print head unit 30. One end of the first ink circulation path 63 is connected to the ink cartridge 12 (the first ink circulation port 13), and the other end thereof is connected to the print head unit 30. The first ink circulation path 63 is configured by a tube which has flexibility, and can be configured by, for example, a tube made of silicon rubber.

The print head unit 30 includes heads (serial heads) which perform so-called serial type printing. As shown in FIG. 2, the print head unit 30 includes a nozzle plate 34, a first ink circulation port 38, a second ink circulation port 39, an ink storage chamber 32, a pressure generation chamber 36, an ink passage 33, and a piezoelectric element 31.

The nozzle plate 34 is a laminated member in which a plurality of nozzles 35 are formed, and can be formed using, for example, a thin stainless steel plate. In FIG. 2, only a single nozzle 35 is shown for convenience of illustration, and the pressure generation chamber 36, the ink passage 33 and the piezoelectric element 31, which correspond to the single nozzle 35, are shown. Meanwhile, the ink storage chamber 32, the first ink circulation port 38 and the second ink circulation port 39 correspond to the plurality of nozzles 35.

The first ink circulation port 38 is connected to the first ink circulation path 63. In this embodiment, the first ink circulation port 38 is used as the ink reception port of the print head unit 30 (ink storage chamber 32). The second ink circulation port 39 is connected to a second ink circulation path 61 which will be described later. In this embodiment, the second ink circulation port 39 is used as the ink exhaust port of the print head unit 30 (ink storage chamber 32).

The ink storage chamber 32 is connected to each of the first ink circulation port 38, the second ink circulation port 39, and the ink passage 33. The ink storage chamber 32 temporarily stores ink which is supplied from the ink cartridge 12. The pressure generation chamber 36 is connected to the nozzle 35 and the ink passage 33, and supplies ink which is supplied from the ink passage 33 to the nozzle 35. The ink passage 33 is connected to the ink storage chamber 32 and the pressure generation chamber 36, and supplies ink which is supplied from the ink storage chamber 32 to the pressure generation chamber 36. The side of the ink passage 33 which comes into contact with the piezoelectric element 31 has flexibility. Meanwhile, the ink storage chamber 32, the ink passage 33, or the pressure generation chamber 36 can be formed by providing a groove or a cavity in the base material of the print head unit 30. In this configuration, it is preferable to configure the print head unit 30 using a base material having high heat conductivity as the base material of the print head unit 30. The reason for this is that it is easy to conduct the heat of the piezoelectric element 31 to the ink in the ink storage chamber 32 as will be described later.

The piezoelectric element 31 is arranged to come into contact with one side of the ink passage 33 (the above-described side having flexibility). The piezoelectric element 31 is a piezoelectric element which is a capacitive load, and is bent when a voltage having a predetermined time width is applied between electrodes which are not shown in the drawing, thereby changing (contracting) the ink passage 33. An amount of ink corresponding to the bending is supplied from the pressure generation chamber 36 to the nozzle 35, and discharged from the nozzle 35 as ink droplets. Meanwhile, among the ink temporarily stored in the ink storage chamber 32, ink is discharged from the second ink circulation port 39 to the second ink circulation path 61 excepting ink which is supplied to the ink passage 33 so as to be discharged from the nozzle 35.

The second ink circulation path 61 and the third ink circulation path 62 are included in the above-described ink circulation tube bundle 60. In this embodiment, the ink circulation tube bundle 60 can be used as a flow path (an ink return path) in order to return the ink which is discharged from the print head unit 30 to the ink cartridge 12 via the cooling device 50. One end of the second ink circulation path 61 is connected to the cooling device 50 (a heat exchange unit 51 which will be described later), and the other end thereof is connected to the ink cartridge 12 (the second ink circulation port 39). One end of the third ink circulation path 62 is connected to the print head unit 30 (the second ink circulation port 39), and the other end thereof is connected to the cooling device 50 (the heat exchange unit 51 which will be described later). Like the above-described first ink circulation path 63, both the second ink circulation path 61 and the third ink circulation path 62 are configured using tubes having flexibility (for example, a tube made of silicon rubber).

The pump 40 is arranged in the second ink circulation path 61, and sends ink which is discharged from the second ink circulation port 39 of the print head unit 30 to the cooling device 50 (the heat exchange unit 51 which will be described later).

The cooling device 50 includes the heat exchange unit 51 and the fan 52, and cools ink which is discharged from the print head unit 30.

The heat exchange unit 51 is connected to each of the second ink circulation path 61 and the third ink circulation path 62. The heat exchange unit 51 performs heat exchange between ink which is supplied from the second ink circulation path 61 and air, and discharges ink which is obtained after heat exchange is performed to the third ink circulation path 62. In this embodiment, the heat exchange unit 51 includes a case which is formed by a base material having high heat conductivity and a serpentine-type flow path which is formed in the case. The case can be formed by a base material having higher heat conductivity than the base material (for example, silicon rubber) of the ink flow path (for example, the first ink circulation path 63, the third ink circulation path 62, or the second ink circulation path 61) in the printing apparatus 100, for example, a base material having heat conductivity which is equal to or greater than 190 W/mK and less than 210 W/mK. Although, for example, aluminum can be used as such a base material, other metals such as copper or stainless steel can be used instead of aluminum.

The fan 52 is arranged in the vicinity of the heat exchange unit 51, is rotated by a motor which is not shown in the drawing (hereinafter, referred to as a "fan drive motor"), and sends air to the heat exchange unit 51. The heat of the ink is emitted to the air via the case of the heat exchange unit 51 when ink passes through the flow path in the heat exchange unit 51. As described above, in this embodiment, the case of the heat exchange unit 51 is formed of a base material having higher heat conductivity compared to other flow paths (for example, the first ink circulation path 63, the third ink circulation path 62, and the second ink circulation path 61), and air flow is continuously applied to the case of the heat exchange unit 51, thereby causing the cooling efficiency of ink of the flow path in the heat exchange unit 51 to be higher than the cooling efficiency of ink of other flow paths.

The main control circuit 70 is electrically connected to the print head unit 30 (the piezoelectric element 31), the carriage motor 2, the pump 40, the fan 52, the fan drive motor which is not shown in the drawing, and the paper feed motor which is not shown in the drawing. The main control circuit 70 includes a Central Processing Unit (CPU) 71, a Random Access Memory (RAM) 72, and an Electrically Erasable and Programmable Read Only Memory (EEPROM) 73.

The CPU 71 controls the entire printing apparatus 100 by deploying a program which is stored in the EEPROM 73 to the RAM 72. For example, the CPU 71 receives an on/off signal which is output from a client which is not shown in the drawing (for example, a personal computer) in order to form dots, and performs an ink droplet discharging operation by driving the piezoelectric element 31 based on the signal. In addition, the CPU 71 causes the carriage 10 to reciprocate in such a way as to drive the carriage motor 2. In addition, the CPU 71 controls the amount of ink circulation in such a way as to control the on/off of the pump 40. In addition, the CPU 71 controls the amount of supplied air in such a way so as to control the number of rotations of the fan 52, thereby controlling the temperature of ink which circulates in the printing apparatus 100. More specifically, the CPU 71 strongly suppresses the rise in the temperature of ink by raising the degree of cooling of ink in such a way as to increase the number of rotations of the fan 52, and weakly suppresses the rise in the temperature of ink by reducing the degree of cooling of ink in such a way as to decrease the number of rotations of the fan 52. The degree of cooling means the efficiency obtained when the temperature of ink is reduced, for example, the lowered temperature of ink of unit volume per unit time (° C./cm$^3$·sec) or the amount of heat of ink which is diffused in the air for one second per unit surface area (cal/cm$^2$·sec). Meanwhile, the number of rotations of the fan 52 can be controlled by controlling the amount of electric power which is supplied to the fan drive motor which is not shown in the drawing. Therefore, the CPU 71 increases the number of rotations of the fan 52 in such a way as to increase the amount of power which is supplied to the fan drive motor, and reduces the number of rotations of the fan 52 in such a way as to reduce the amount of power which is supplied to the fan drive motor.

The printing apparatus 100 which has the above-described configuration is formed with an ink circulation path which passes through the ink cartridge 12, the print head unit 30, and the cooling device 50. More specifically, in the printing apparatus 100, an ink circulation path is formed through which ink passes through the ink cartridge 12, the first ink circulation path 63, the print head unit 30 (the ink storage chamber 32), the second ink circulation path 61, the pump 40, the cooling device 50 (the heat exchange unit 51), and the third ink circulation path 62 in this order, and returns to the ink cartridge 12 again. The printing apparatus 100 can cause ink to circulate along the ink circulation path, and can control the rise in the temperature of the print head unit 30 in such a way as to perform cooling in the cooling device 50.

This embodiment is configured such that ink which is cooled in the cooling device 50 flows into the ink cartridge 12 by providing the cooling device 50 on the upstream side of the ink cartridge 12. The reason for using such a configuration is that various types of base materials can be used as the base material of the ink cartridge 12 regardless of heat resistance and the manufacturing cost of the ink cartridge 12 can be restrained because the rise in the temperature of the ink cartridge 12 can be suppressed. In addition, it is possible to suppress the variation in the physical properties of ink in the ink cartridge 12 using ink which returns to the ink cartridge 12 and has high temperature.

The above-described piezoelectric element 31, the nozzle 35, the pressure generation chamber 36, the ink passage 33, and the ink storage chamber 32 correspond to an ink discharging device of the claims.

A2. Cooling of Printing Head

When high-speed printing or high-resolution printing is performed, the amount of generated heat increases in order for the piezoelectric element 31 to perform a bending operation. Since the ink passage 33 is arranged to come into contact with the piezoelectric element 31, the ink passage 33 is thermally connected to the piezoelectric element 31. Therefore, along with the increase in the amount of generated heat of the piezoelectric element 31, the temperature of the ink passage 33 rises. In addition, because of the same reason, the temperature of the ink storage chamber 32 which is connected to the ink passage 33 rises. In addition, in order to raise the temperatures in the case of the print head unit 30 or the nozzle plate 34 along with the rise in the temperature of the piezoelectric element 31, the temperature of the ink storage chamber 32 which comes into contact with the case of the print head unit 30 or the nozzle plate 34 rises. As will be described later, since cooled ink is supplied to the ink storage chamber 32, the temperature of the ink which is supplied to the ink storage chamber 32 rises while the ink is stored in the ink storage chamber 32.

The ink, the temperature of which rises, in the ink storage chamber 32, is discharged from the second ink circulation port 39 to the second ink circulation path 61 by the operation of the pump 40, and supplied to the heat exchange unit 51. The ink which is supplied to the heat exchange unit 51 performs heat exchange with the air via the case of the heat exchange unit 51. At this time, since air flow which is sent from the fan 52 is applied to the case of the heat exchange unit 51, the temperature of the air in the vicinity of the heat exchange unit 51 is lower than the temperature of ink in the heat exchange unit 51. Therefore, the heat of ink in the heat exchange unit 51 is emitted to the air, and ink which is discharged from the print head unit 30 is cooled. Ink which is cooled in the heat exchange unit 51 returns to the ink cartridge 12 via the third ink circulation path 62, and is supplied from the ink cartridge 12 to the print head unit 30 (the ink storage chamber 32) via the first ink circulation path 63.

As described above, since ink which is cooled in the cooling device 50 is continuously supplied in the ink storage chamber 32, heat which is generated by the drive of the piezoelectric element 31 is continuously transported to the heat exchange unit 51 by ink and is emitted to the air. Therefore, the rise in the temperature of the print head unit 30 is continuously suppressed. Meanwhile, in this embodiment, "suppressing the rise in temperature of the print head unit 30" means maintaining the temperature of the print head unit 30 at the same temperature or reducing the degree of the rise in the temperature (risen temperature per unit time when the piezoelectric element 31 is equally driven) of the print head unit 30 compared to a case in which ink circulation in the ink circulation path or ink cooling using the cooling device 50 is not performed.

As described above, in the printing apparatus 100 according to the first embodiment, the ink circulation path which combines with the ink cartridge 12, the print head unit 30, and the cooling device 50 is formed. Therefore, ink, the temperature of which rises in the print head unit 30, can be cooled in the cooling device 50, and cooled ink can be supplied to the print head unit 30 via the ink cartridge 12. Therefore, since heat which is generated in the print head unit 30 (the piezoelectric element 31) can be emitted to the air by transferring the heat to the cooling device 50 using ink, it is possible to suppress a rise in the temperature of the print head unit 30.

In addition, since ink which is discharged from the print head unit 30 returns to the ink cartridge 12 after being cooled in the cooling device 50, it is possible to suppress a rise in the temperature of ink in the ink cartridge 12. Therefore, it is possible to use various types of materials as the base material of the ink cartridge 12 regardless of heat resistance, and possible to suppress the manufacturing cost of the ink cartridge 12. In addition, since it is possible to suppress a rise in the temperature of ink in the ink cartridge 12, it is possible to suppress the variation in the physical properties of ink in the ink cartridge 12.

In addition, since ink which is supplied from the ink cartridge 12 is used as a cooling medium, it is possible to restrain the manufacturing cost of the printing apparatus 100 compared to a configuration in which a cooling medium that is different from ink is used.

B. Second Embodiment

Figure 3:
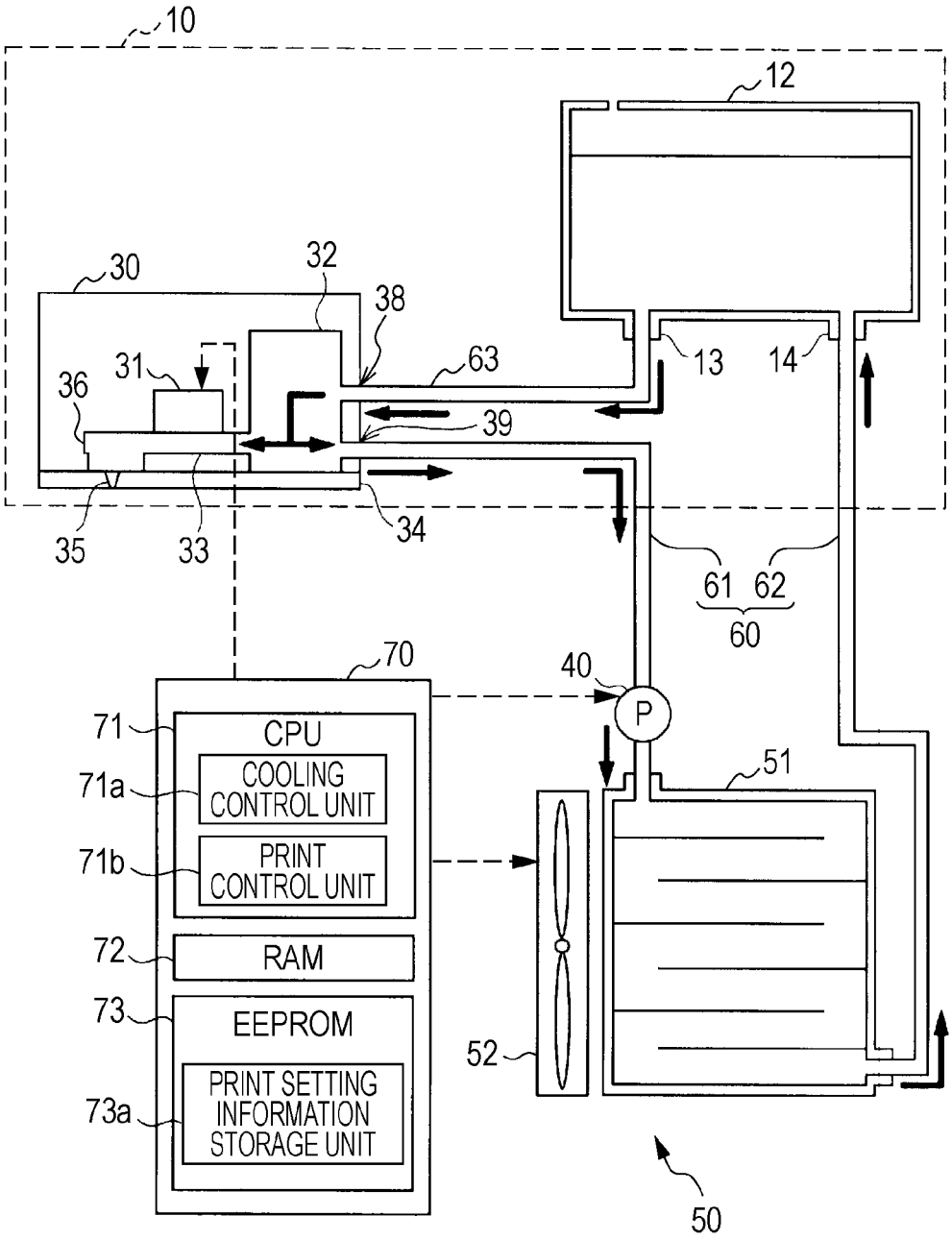
FIG. 3 is an explanatory view schematically illustrating the ink circulation path of a printing apparatus according to a second embodiment.

FIG. 3 is an explanatory view schematically illustrating the ink circulation path of a printing apparatus according to a second embodiment. The printing apparatus according to the second embodiment is different from the printing apparatus 100 according to the first embodiment in that the CPU 71 functions as a cooling control unit 71*a* and a print control unit 71*b*, in that the EEPROM 73 includes a print setting information storage unit 73*a*, and in that the degree of cooling of ink varies depending on a print speed, and other configurations are the same as those of the printing apparatus 100 according to the first embodiment.

The cooling control unit 71*a* performs a cooling control process which will be described later. The print control unit 71*b* performs printing in such a way as to control the piezoelectric element 31 and the carriage motor 2 based on a print job which is transmitted from a client which is not shown in the drawing. The print setting information storage unit 73*a* stores information included in the print job which is transmitted from the client (dot on/off data or a print run) and information of printing conditions (a print speed and a print resolution). In the printing apparatus according to the second embodiment, two types of speeds, that is, a low speed and a high speed may be set as the print speed. For example, 30 ppm (pages per minute) may be set as a low speed and 60 ppm may be set as a high speed, respectively. When the user inputs the setting value of the print speed using the client, which is not shown in the drawing, the setting value is transmitted to the main control circuit 70, and the print control unit 71*b* stores the received setting value of the print speed of the print setting information storage unit 73*a*. Meanwhile, in the second embodiment, the cooling control unit 71*a* corresponds to a cooling controller and a speed setting value acquisition unit of the claims.

Figure 4:
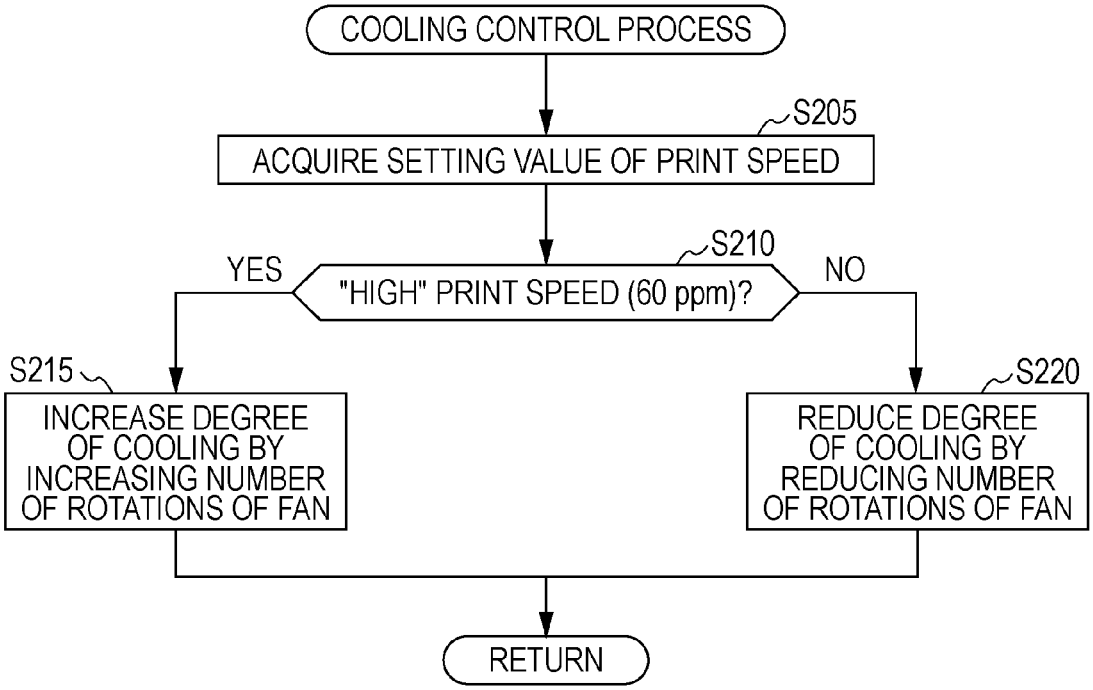
FIG. 4 is a flowchart illustrating the procedure of the cooling control process of the printing apparatus according to the second embodiment.

FIG. 4 is a flowchart illustrating the procedure of the cooling control process of the printing apparatus according to the second embodiment. When the power of the printing apparatus is turned on, the cooling control unit 71*a* performs the cooling control process.

The cooling control unit 71*a* acquires the set value of the print speed from the print setting information storage unit 73*a* in step S205, and determines whether or not the print speed is set to a high speed (for example, 60 ppm) in step S210.

When the print speed is set to a high speed (YES in step S210), the cooling control unit 71*a* increases the degree of cooling of ink in the heat exchange unit 51 by increasing the number of rotations of the fan 52 in step S215. Meanwhile, in order to increase the number of rotations of the fan 52, an arbitrary method, for example, a method of raising the number of rotations up to a predetermined number of rotations or a method of raising the current number of rotations by a predetermined number of rotations may be used.

Meanwhile, when the print speed is not set to a high speed, that is, when the print speed is set to a low speed (NO in step S210), the cooling control unit 71*a* reduces the degree of cooling of ink of the heat exchange unit 51 by reducing the number of rotations of the fan 52 in step S220. Meanwhile, in order to reduce the number of rotations of the fan 52, an arbitrary method, for example, a method of reducing the number of rotations up to a predetermined number of rotations or a method of reducing the current number of rotations by a predetermined number of rotations may be used.

As described above, the reasons that the degree of cooling of ink is increased when a high speed is set as the print speed and that the degree of cooling of ink is reduced when a low speed is set as the print speed are as below. When the print speed is set to a high speed, the bending operation of the piezoelectric element 31 is performed at a high speed in order to perform high-speed printing, and thus the amount of generated heat of the piezoelectric element 31 is high compared to the case of the low speed printing. Therefore, in the printing apparatus according to the second embodiment, when the print speed is set to a high speed, the degree of cooling of ink is increased by increasing the number of rotations of the fan 52, thereby suppressing the excessive rise in the temperature of the print head unit 30. In addition, when the print speed is set to a low speed, the bending operation of the piezoelectric element 31 is performed at a comparatively low speed, and thus the amount of generated heat of the piezoelectric element 31 is comparatively low. Therefore, in the printing apparatus according to the second embodiment, when the print speed is set to a low speed, the amount of electric power which is necessary to rotate the fan 52 is restrained by reducing the number of rotations of the fan 52, and the deterioration of the fan drive motor of the fan 52, which is not shown in the drawing, is restrained.

The above-described printing apparatus according to the second embodiment has the same advantages as the printing apparatus 100 according to the first embodiment. In addition, when the print speed is a high speed, the printing apparatus according to the second embodiment increases the degree of cooling of ink by increasing the number of rotations of the fan 52, thus it is possible to suppress a rise in the temperature of the print head unit 30 even when the amount of generated heat of the print head unit 30 (piezoelectric element 31) increases along with high-speed printing. In addition, when the print speed is a low speed, the number of rotations of the fan 52 is reduced, thus it is possible to restrain the amount of electric power which is necessary to rotate the fan 52, and possible to restrain the deterioration of the fan drive motor of the fan 52, which is not shown in the drawing.

C. Third Embodiment

Figure 5:
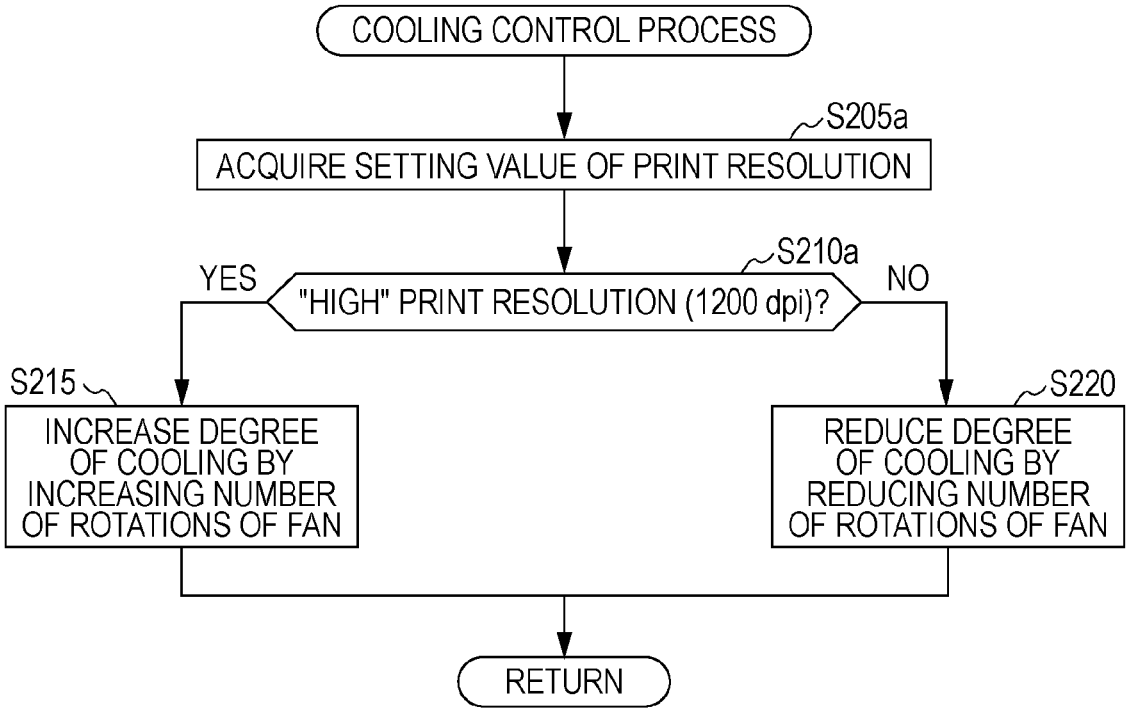
FIG. 5 is a flowchart illustrating the procedure of the cooling control process of a printing apparatus according to a third embodiment.

FIG. 5 is a flowchart illustrating the procedure of the cooling control process of a printing apparatus according to a third embodiment. The printing apparatus according to the third embodiment is different from the printing apparatus according to the second embodiment in that the number of rotations of the fan 52 is controlled depending on set print resolution, and other configurations and other processes in the cooling control process are the same as those of the printing apparatus according to the second embodiment. More specifically, a cooling control process according to the third embodiment is different from the cooling control process according to the second embodiment shown in FIG. 4 in that step S205*a* is performed instead of step S205 and in that step S210*a* is performed instead of step S210, and other procedures are the same as those of the cooling control process according to the second embodiment. Meanwhile, in the third embodiment, the cooling control unit 71*a* corresponds to the cooling controller and a resolution setting value acquisition unit of the Claims.

In the printing apparatus according to the third embodiment, two types of resolution, that is, low resolution and high resolution may be set as the print resolution. For example, 600 dpi (dots per inch) may be set as low resolution and 1200 dpi may be set as high resolution, respectively. If the user inputs the setting value of the print resolution using the client, which is not shown in the drawing, the setting value is transmitted to the main control circuit 70, and the print control unit 71*b* stores the received setting value of the print resolution in the print setting information storage unit 73*a*.

As shown in FIG. 5, the cooling control unit 71*a* acquires the setting value of the print resolution from the print setting information storage unit 73*a* in step S205*a*, and determines whether or not the print speed is set to a high resolution (for example, 1200 dpi) in step S210*a*.

When the print resolution is set to high resolution (YES in step S210*a*), the above-described step S215 is performed, the number of rotations of the fan 52 increases, and the degree of cooling of ink of the heat exchange unit 51 increases. Meanwhile, when the print speed is set to a high resolution, that is, when the print speed is set to a low resolution (NO in step S210*a*), the above-described step S220 is performed, the number of rotations of the fan 52 decreases, and the degree of cooling of ink of the heat exchange unit 51 is reduced.

As described above, the reason that the degree of cooling of ink increases when high resolution is set as the print resolution is as follows. When the print resolution is set to high resolution, the bending operation of the piezoelectric element 31 is performed at a high speed in order to perform high-resolution printing, and thus the amount of generated heat of the piezoelectric element 31 is high compared to a case of low resolution printing. Therefore, in the printing apparatus according to the third embodiment, when the print resolution is set to high resolution, the degree of cooling of ink is increased by increasing the number of rotations of the fan 52, thereby suppressing the excessive rise in the temperature of the print head unit 30. In addition, when the print resolution is set to a low resolution, the bending operation of the piezoelectric element 31 is performed at a comparatively low speed, thus the amount of generated heat of the piezoelectric element 31 is comparatively low. Therefore, in the printing apparatus according to the third embodiment, when the print resolution is set to a low resolution, the number of rotations of the fan 52 is reduced, the amount of electric power which is necessary to rotate the fan 52 is restrained, and the deterioration of the fan 52 or the fan drive motor, which is not shown in the drawing, is restrained.

The above-described printing apparatus according to the third embodiment has the same advantages as the printing apparatus 100 according to the first embodiment. In addition, in the printing apparatus according to the third embodiment, when the print resolution is set to high resolution, the degree of cooling of ink is increased by increasing the number of rotations of the fan 52, thus it is possible to suppress a rise in the temperature of the print head unit 30 even when the amount of generated heat of the print head unit 30 (the piezoelectric element 31) increases along with high-resolution printing. In addition, when the print resolution is set to a low resolution, the number of rotations of the fan 52 decreases, thus it is possible to restrain the amount of electric power which is necessary to rotate the fan 52, and possible to restrain the deterioration of the fan 52 or the fan drive motor, which is not shown in the drawing.

D. Fourth Embodiment

Figure 6:
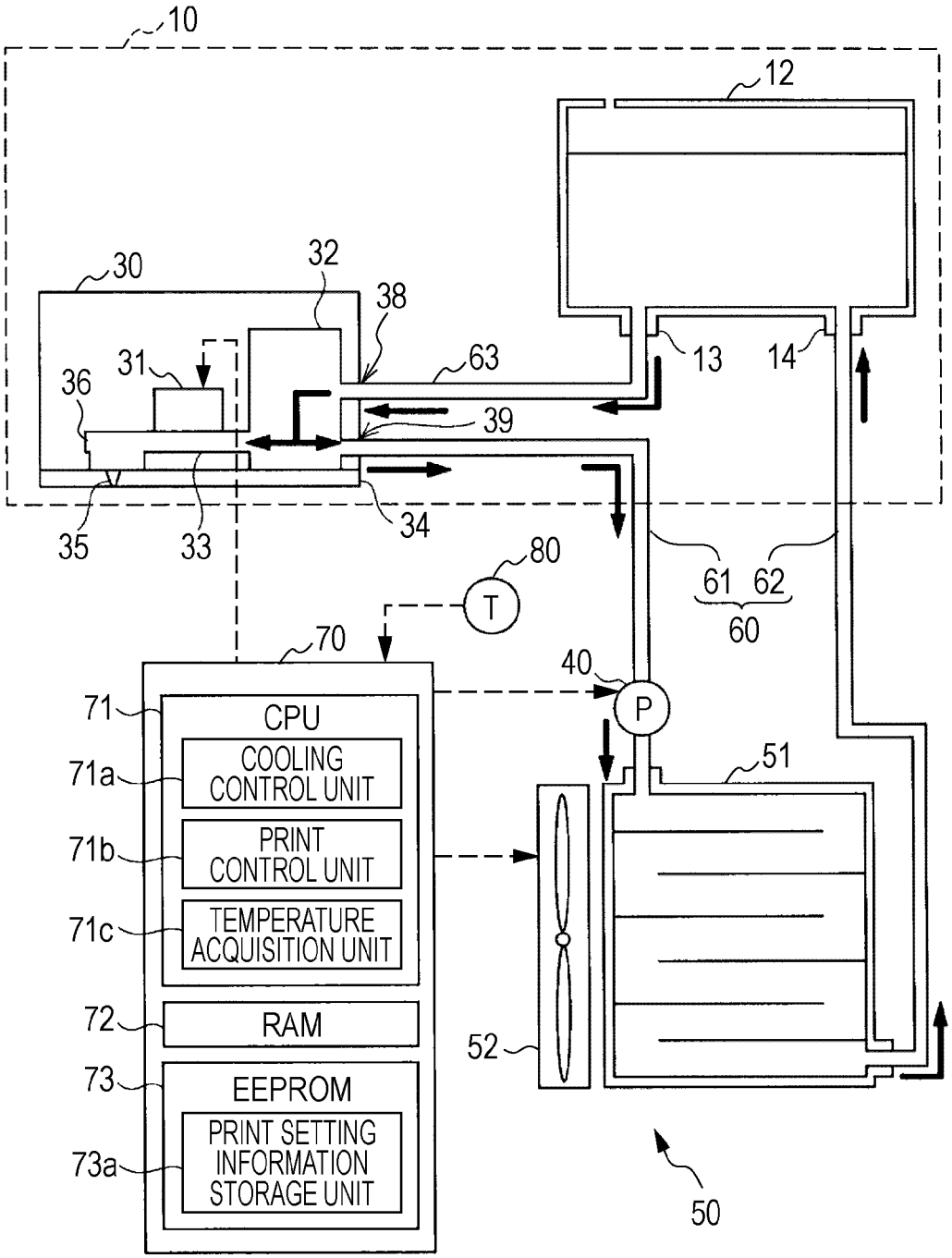
FIG. 6 is an explanatory view schematically illustrating the ink circulation path of a printing apparatus according to a fourth embodiment.

FIG. 6 is an explanatory view schematically illustrating the ink circulation path of a printing apparatus according to a fourth embodiment. The printing apparatus according to the fourth embodiment is different from the printing apparatus according to the second embodiment in that the CPU 71 functions as a temperature acquisition unit 71*c* in addition to the cooling control unit 71*a* and the print control unit 71*b*, in that a temperature sensor 80 is provided, and in that the degree of cooling of ink varies depending on the temperature of the printing apparatus, and other configurations are the same as those of the printing apparatus according to the second embodiment.

The temperature sensor 80 is arranged in the printing apparatus, and measures temperature which represents the inside of the printing apparatus. An arbitrary position in the housing of the printing apparatus can be used as a position at which the temperature sensor 80 is arranged, for example, a position which comes into contact with any flow path among the first ink circulation path 63, the second ink circulation path 61, and the third ink circulation path 62, or a position which comes into contact with any one of the print head unit 30, the ink cartridge 12, and the heat exchange unit 51. The temperature sensor 80 is electrically connected to the main control circuit 70. The temperature acquisition unit 71*c* acquires a temperature value which is measured by the temperature sensor 80. Meanwhile, in the fourth embodiment, the temperature sensor 80 corresponds to a temperature measurement unit of Claims.

Figure 7:
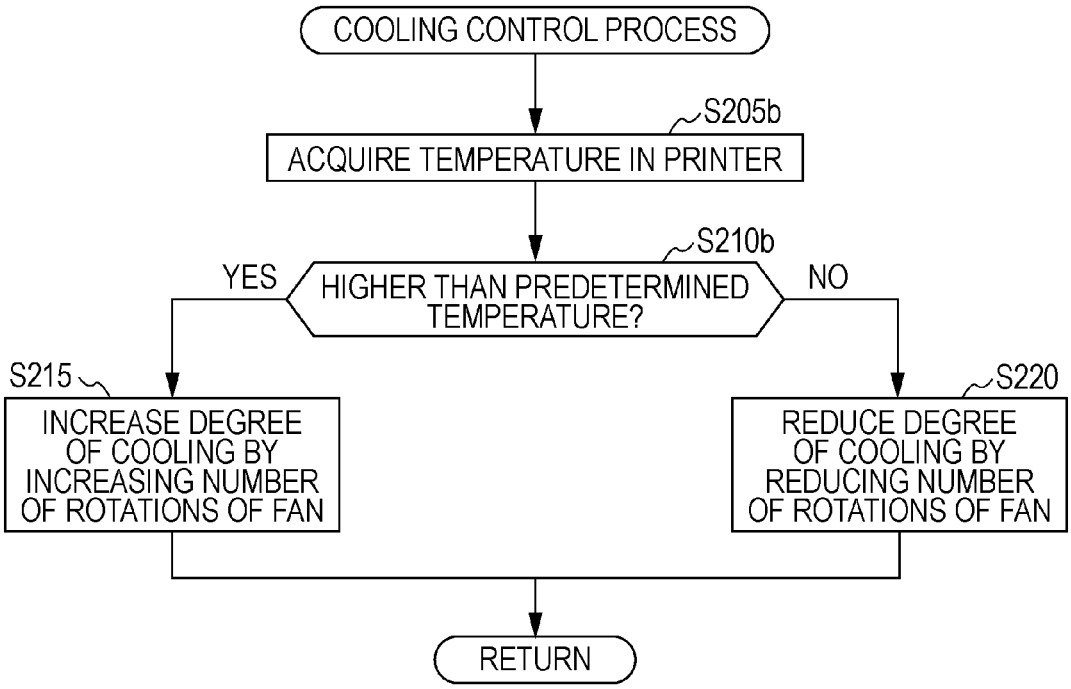
FIG. 7 is a flowchart illustrating the procedure of the cooling control process of the printing apparatus according to the fourth embodiment.

FIG. 7 is a flowchart illustrating the procedure of a cooling control process performed by the printing apparatus according to the fourth embodiment. The cooling control process according to the fourth embodiment is different from the cooling control process according to the second embodiment shown in FIG. 4 in that step S205*b* is performed instead of step S205 and in that step S210*b* is performed instead of step S210, and other procedures are the same as those of the cooling control process according to the second embodiment.

The cooling control unit 71*a* acquires the temperature in the printing apparatus 100 by controlling the temperature acquisition unit 71*c* in step S205*b*, and determines whether or not the acquired temperature is higher than a predetermined temperature in step S210*b*. The predetermined temperature can be arbitrarily set. For example, an upper-limit temperature in a temperature range in which the piezoelectric element 31 can be normally operated is acquired in advance using an experiment, and the upper-limit temperature or a temperature which is slightly lower than the upper-limit temperature can be set.

When the temperature in the printing apparatus 100 is higher than the predetermined temperature (YES in step S210*b*), the above-described step S215 is performed and the number of rotations of the fan 52 increases, thus the degree of cooling of ink of the heat exchange unit 51 increases. Meanwhile, when the temperature in the printing apparatus 100 is higher than the predetermined temperature, that is, when the internal temperature is equal to or lower than the predetermined temperature (NO in step S210*b*), the above-described step S220 is performed and the number of rotations of the fan 52 decreases, thus the degree of cooling of ink of the heat exchange unit 51 is reduced.

The above-described printing apparatus according to the fourth embodiment has the same advantages as the printing apparatus 100 according to the first embodiment. In addition, in the printing apparatus according to the fourth embodiment, when the temperature in the printing apparatus 100 is higher than the predetermined temperature, the degree of cooling of ink is increased by increasing the number of rotations of the fan 52. Therefore, even when high-speed printing is performed or the amount of generated heat of the head unit 30 (the piezoelectric element 31) increases along with high-resolution printing, it is possible to suppress a rise in the temperature of the print head unit 30. In addition, when the temperature in the printing apparatus 100 is equal to or lower than the predetermined temperature, the number of rotations of the fan 52 is reduced. Therefore, it is possible to restrain the amount of electric power which is necessary to rotate the fan 52, and possible to restrain the deterioration of the fan drive motor of the fan 52, which is not shown in the drawing.

E. Fifth Embodiment

Figure 8:
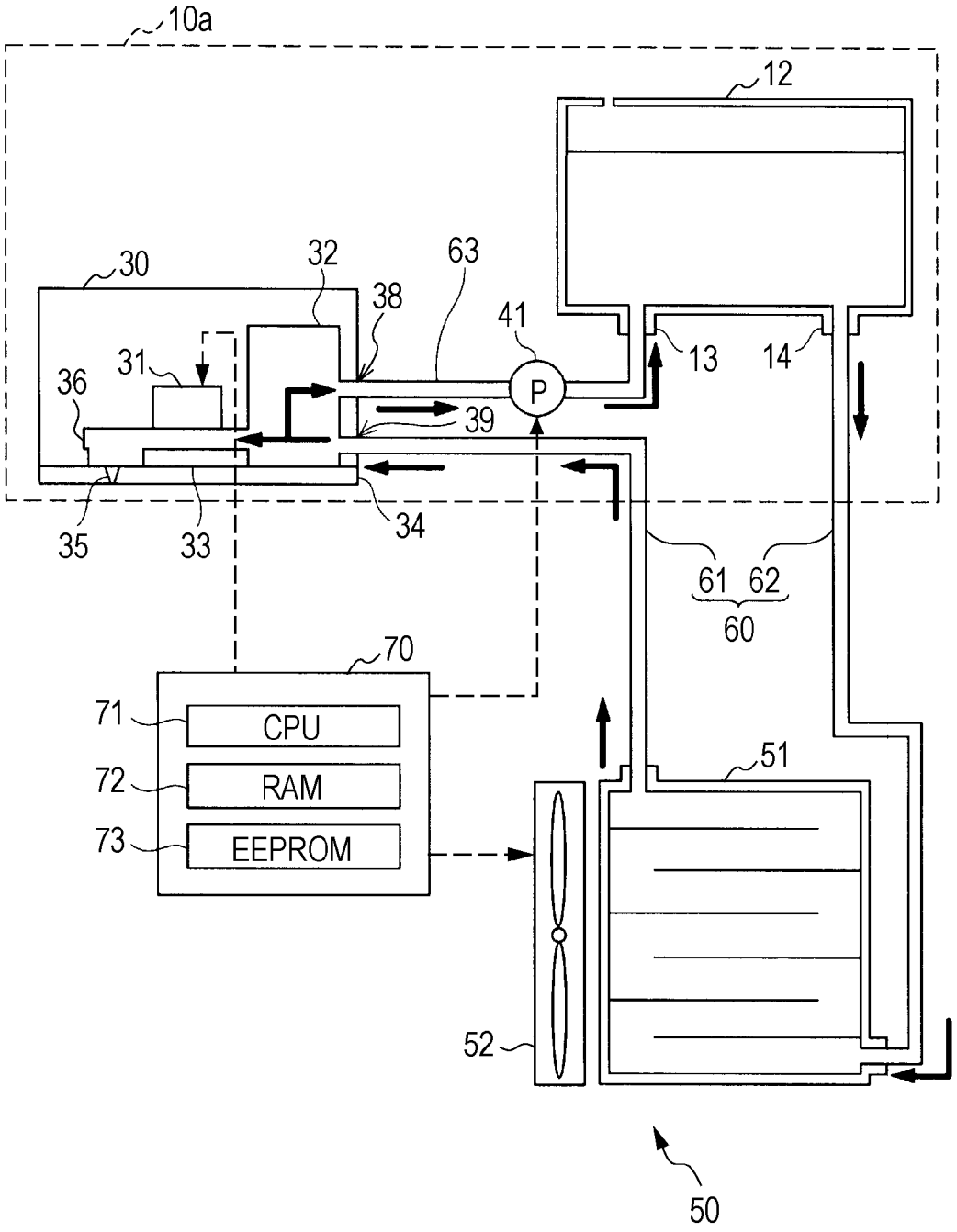
FIG. 8 is an explanatory view schematically illustrating the ink circulation path of a printing apparatus according to a fifth embodiment.

FIG. 8 is an explanatory view schematically illustrating the ink circulation path of a printing apparatus according to a fifth embodiment. The printing apparatus according to the fifth embodiment is different from the printing apparatus 100 according to the first embodiment in that a position at which the pump is arranged is the first ink circulation path 63 instead of the second ink circulation path 61, and in that the direction of ink circulation is reversed. Other configurations are the same as those of the printing apparatus 100 according to the first embodiment.

In the fifth embodiment, the pump 41 is arranged in the first ink circulation path 63. The pump 41 sends ink from the print head unit 30 to the ink cartridge 12. Therefore, in the printing apparatus according to the fifth embodiment, an ink circulation path is formed through which ink passes through the ink cartridge 12, the third ink circulation path 62, the cooling device 50 (the heat exchange unit 51), the second ink circulation path 61, the print head unit 30 (the ink storage chamber 32), and the first ink circulation path 63 (pump 41) in this order and returns to the ink cartridge 12 again. In such an ink circulation path, the third ink circulation path 62 and the second ink circulation path 61 correspond to an ink supply path, and the first ink circulation path 63 corresponds to an ink return path.

Meanwhile, in the fifth embodiment, the first ink circulation port 13 is used as the ink exhaust port of the ink cartridge 12. In addition, the second ink circulation port 14 is used as the ink exhaust port of the ink cartridge 12, the first ink circulation port 38 is used as the ink exhaust port of the print head unit 30 (the ink storage chamber 32), and the second ink circulation port 39 is used as the ink reception port of the print head unit 30 (the ink storage chamber 32), respectively.

The above-described printing apparatus according to the fifth embodiment has the same advantages as the printing apparatus 100 according to the first embodiment. In addition, in the ink circulation path according to the fifth embodiment, ink which is discharged from the print head unit 30 passes through the ink cartridge 12, and is supplied to the cooling device 50. Therefore, ink which is discharged from the print head unit 30 is cooled by being mixed with ink in the ink cartridge 12, and supplied to the cooling device 50. Therefore, since it is possible to suppress the amount of cooling of the cooling device 50, it is possible to suppress the number of rotations of the fan 52, it is possible to restrain the amount of electric power in the fan 52, and it is possible to restrain the deterioration of the fan 52.

F. Sixth Embodiment

Figure 9:
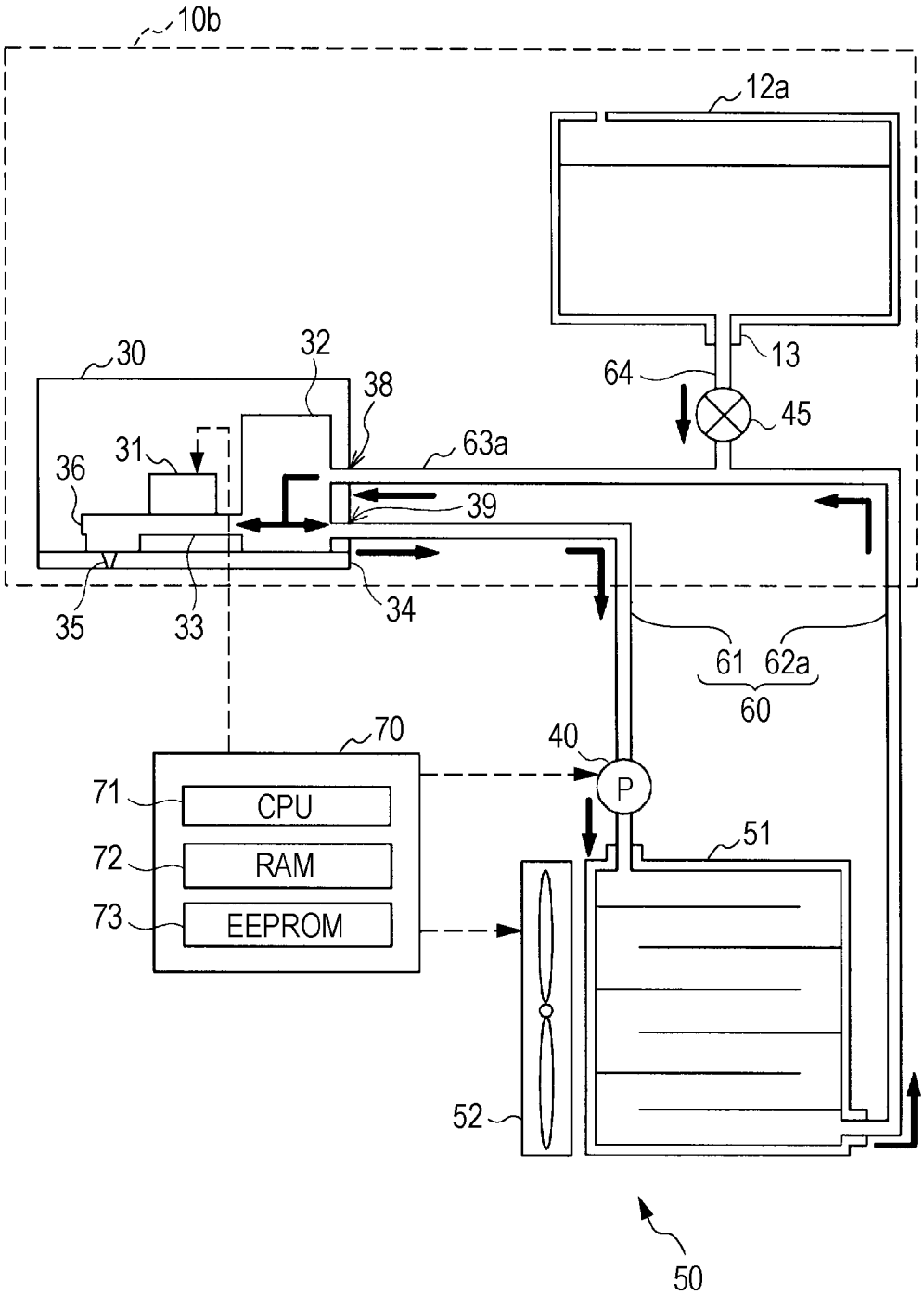
FIG. 9 is an explanatory view schematically illustrating the ink circulation path of a printing apparatus according to the sixth embodiment.

FIG. 9 is an explanatory view schematically illustrating the ink circulation path of a printing apparatus according to the sixth embodiment. The printing apparatus according to the sixth embodiment is different from the printing apparatus 100 according to the first embodiment in that the ink cartridge is included in the ink circulation path.

More specifically, the ink cartridge 12*a* according to the sixth embodiment is different from the ink cartridge 12 according to the first embodiment shown in FIG. 2 in that the ink cartridge 12*a* does not include the second ink circulation port 14, and in that the first ink circulation port 13 is connected to the ink supply path 64 instead of the first ink circulation path 63.

The ink supply path 64 is connected to the first ink circulation port, and supplies ink which is discharged from the ink cartridge 12*a* to a first ink circulation path 63*a* which will be described later. One end of the ink supply path 64 is connected to the first ink circulation port, and the other end thereof is connected to the first ink circulation path 63*a* and a third ink circulation path 62*a* which will be described later. In the ink supply path 64, a non-return valve 45 is arranged. The non-return valve 45, of the flow of ink in the ink supply path 64, permits flow towards the first ink circulation path 63*a* which will be described later from the ink cartridge 12, and suppress the flow which is opposite to the above flow (flow towards the ink cartridge 12 from the first ink circulation path 63*a* and a third ink circulation path 62*a* which will be described later).

The first ink circulation path 63*a* according to the sixth embodiment is different from the first ink circulation path 63 according to the first embodiment in that one end of the first ink circulation path 63*a* is connected to the ink supply path 64 and the third ink circulation path 62*a* which will be described later instead of the first ink circulation port 13. The third ink circulation path 62*a* according to the sixth embodiment is different from the third ink circulation path 62 according to the first embodiment in that one end of the third ink circulation path 62*a* is connected to the first ink circulation path 63*a* and the ink supply path 64 instead of the second ink circulation port 14.

In the printing apparatus according to the sixth embodiment which has the above-described configuration, ink which is discharged from the ink cartridge 12*a* passes through the ink supply path 64 (the non-return valve 45) and is supplied to the first ink circulation path 63*a*, that is, ink passes through the first ink circulation path 63*a*, the print head unit 30 (the ink storage chamber 32), the second ink circulation path 61, the pump 40, the cooling device 50 (the heat exchange unit 51), and the third ink circulation path 62*a* in this order, and returns to the first ink circulation path 63*a* again.

The above-described printing apparatus according to the sixth embodiment has the same advantages as the printing apparatus 100 according to the first embodiment. In addition, since the ink cartridge 12*a* is not included in the ink circulation path, it is possible to suppress the change in the physical properties of ink in the ink cartridge 12*a* due to ink which returns from the ink circulation path. In addition, since the second ink circulation port 14 is not necessary for the ink cartridge 12*a* according to the sixth embodiment, it is possible to suppress the manufacturing cost of the ink cartridge 12*a*.

G. Seventh Embodiment

Figure 10:
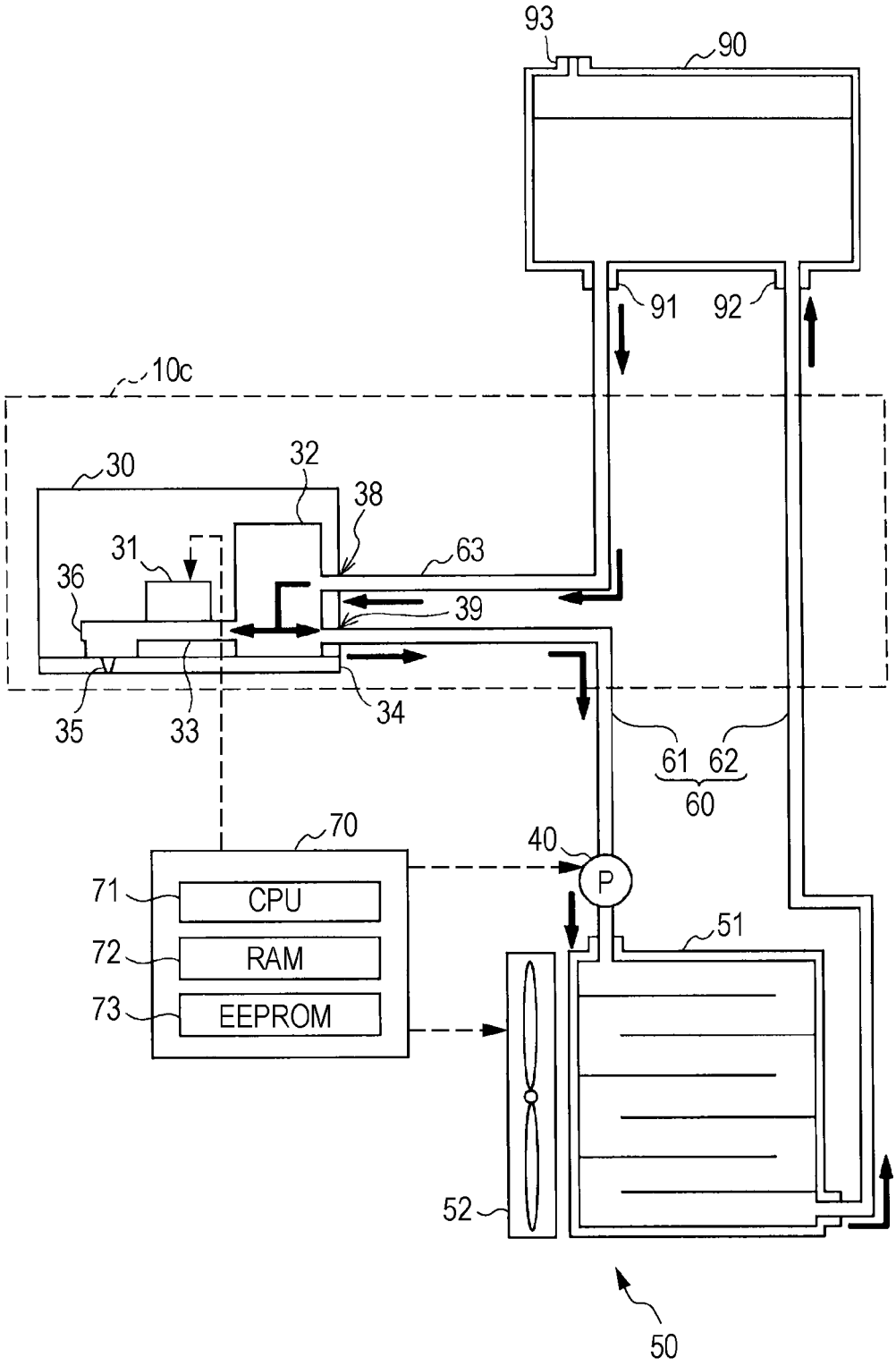
FIG. 10 is an explanatory view schematically illustrating the ink circulation path of a printing apparatus according to a seventh embodiment.

FIG. 10 is an explanatory view schematically illustrating the ink circulation path of a printing apparatus according to a seventh embodiment. The printing apparatus according to the seventh embodiment is a so-called off-carriage type ink jet printer, and different from the printing apparatus 100 according to the first embodiment in that the carriage 10*c* does not include the ink cartridge 12 and in that the printing apparatus includes an ink tank 90. Other configurations are the same as those of the printing apparatus 100 according to the first embodiment.

The ink tank 90 is used for each color, and stores each color of ink. In the printing apparatus, the ink tank 90 is arranged at a position which is different from that of the carriage 10*c*. The ink tank 90 includes an ink exhaust port 91, an ink inflow port 92, and an ink supplement port 93. The ink exhaust port 91 is connected to one end of the first ink circulation path 63. The ink inflow port 92 is connected to one end of the third ink circulation path 62. The ink supplement port 93 is an ink injection port which is used when the ink tank 90 is charged with ink. When ink of the ink tank 90 is exhausted, the user can charge the ink tank 90 with corresponding color ink from the ink supplement port 93.

In the printing apparatus according to the seventh embodiment, an ink circulation path is formed through which ink passes through the ink tank 90, the first ink circulation path 63, the print head unit 30 (the ink storage chamber 32), the second ink circulation path 61, the pump 40, the cooling device 50 (the heat exchange unit 51), and the third ink circulation path 62 in this order, and returns to the ink tank 90 again.

The above-described printing apparatus according to the seventh embodiment has the same advantages as the printing apparatus 100 according to the first embodiment.

H. Modification Example

The invention is not limited to the above-described embodiments or illustrative embodiments, and can be implemented in various types of illustrative embodiments without departing from the gist of the invention. For example, modifications are possible as below.

H1. Modification Example 1

The configuration of the printing apparatus according to each embodiment is merely an example and various modifications are possible. For example, the printing apparatus according to each embodiment is a so-called serial printer. However, a so-called line printer which performs line-type printing can be used instead of the serial printer. In addition, the printing apparatus according to each embodiment is a so-called piezoelectric type printer which uses a piezoelectric element as an ink discharging device. However, a so-called thermal-type printer which uses a heater as the ink discharging device can be used instead of the piezoelectric type printer. In addition, in each embodiment, the number of ink cartridges 12 or 12*a* which are installed on the carriage 10, 10*a*, or 10*b* is four. However, the number of ink cartridges is not limited to four and may be an arbitrary number. For example, a total of six ink cartridges which add ink cartridges for respective light cyan (LC) and light magenta (LM) to the ink cartridges for respective colors, that is, cyan (C), magenta (M), yellow (Y), and black (K) can be installed on the carriage 10, 10*a*, or 10*b* according to each embodiment. In addition, in each embodiment, the cooling device 50 (the heat exchange unit 51 and the fan 52) is arranged at a position which is different from that of the carriage 10, 10*a*, 10*b*, or 10*c*. However, instead of this, the cooling device 50 can be installed on the carriage 10, 10*a*, 10*b*, or 10*c*. In addition, in each embodiment, the ink cartridge 12 or the ink tank 90 is arranged in the printing apparatus, and configured as a part of the printing apparatus. However, instead of this, the ink cartridge 12 or the ink tank 90 can be arranged on the outside of the printing apparatus, and configured as a separate apparatus from the printing apparatus. For example, a configuration, in which the ink tank is arranged on the outside of the printing apparatus and ink is supplied from the ink tank to the printing apparatus (the printing heads in the printing apparatus), can be used.

H2. Modification Example 2

In the embodiments other than the sixth embodiment, all of the ink cartridge 12 and the ink tank 90 form a part of the ink circulation path. However, the invention is not limited thereto. For example, in the print head unit 30 according to the first embodiment, a third ink circulation port which is not shown in the drawing can be provided in addition to the first ink circulation port 38 and the second ink circulation port 39, and one end of the third ink circulation path 62 can be connected to the third ink circulation port of the print head unit 30 instead of the second ink circulation port 14 of the ink cartridge 12. Meanwhile, in this configuration, the second ink circulation port 14 of the ink cartridge 12 can be omitted. In this configuration, an ink circulation path is formed in which ink passes through the print head unit 30, the second ink circulation path 61, the cooling device 50 (the heat exchange unit 51), and the third ink circulation path 62 in this order and returns to the print head unit 30 again. Even in such a configuration, it is possible to obtain the same advantages as those of the sixth embodiment.

H3. Modification Example 3

In each embodiment, the cooling device 50 includes the heat exchange unit 51 and the fan 52. However, the invention is not limited thereto. For example, a Peltier element can be used instead of the fan 52. In this configuration, for example, the Peltier element is arranged to come into contact with or be in the vicinity of the heat exchange unit 51, and thus ink in the heat exchange unit 51 can be cooled by cooling (the surface of) the heat exchange unit 51 using the Peltier element. In addition, for example, a configuration in which the fan 52 is omitted and the fan is provided in the heat exchange unit 51 can be used. Even in this configuration, heat loss is promoted by the fan, thus ink in the heat exchange unit 51 can be cooled. In addition, for example, a configuration in which only the fan 52 is omitted can be used. Even in this configuration, it is possible to raise the cooling efficiency compared to other flow paths (heat exchange is performed between ink and the air via the surface of the flow path) by, as the component member of the heat exchange unit 51, using a material having higher heat conductivity than the member (for example, silicon rubber) which configures other flow paths (for example, the first ink circulation path 63, the third ink circulation path 62, and the second ink circulation path 61) which are different from the flow path in the heat exchange unit 51.

H4. Modification Example 4

In the second embodiment, the print speed which may be set includes only two types of print speeds, that is, a high speed and a low speed. However, the invention is not limited thereto. A configuration in which three or more types of print speeds may be set can be used. In this configuration, when a higher print speed is set, it is possible to control such that a larger number of rotations is set (that is, such that a higher degree of cooling is set). At this time, a table in which a print speed which may be set in advance is associated with the number of rotations of the fan 52 is stored in the printing apparatus. The cooling control unit 71*a* can specify the number of rotations of the fan 52 which corresponds to the print speed acquired in step S205 with reference to the table, and can control the fan 52 such that the number of rotations is the specified number of rotations. Likewise, a configuration in which three or more types of print resolutions may be set can be used in the third embodiment. In addition, in the fourth embodiment, the number of print rotations is increased or decreased depending on whether or not the acquired temperature of the printing apparatus is higher than the predetermined temperature. However, the invention is not limited thereto. For example, a table in which a larger number of rotations is set for the higher temperature of the printing apparatus (that is, so as to be a higher degree of cooling) is prepared in advance based on the results of an experiment, and the cooling control unit 71*a* can specify the number of rotations of the fan 52 which corresponds to the acquired temperature with reference to the table, and can control the fan 52 such that the number of rotations of the fan becomes the specified number of rotations.

H5. Modification Example 5

The ink cartridge which is used in the embodiments other than the seventh embodiment is a cartridge with which ink is charged in advance, and is configured such that, when ink is exhausted therefrom, the user removes the old ink cartridge and installs a new ink cartridge on the carriage 10, 10*a*, 10*b*, or 10*c*. However, the invention is not limited thereto. For example, an ink supply port which is used to charge the ink cartridge with ink is provided. Like the ink tank 90 according to the seventh embodiment, a configuration in which, when ink is exhausted, the user charges with ink using the ink supply port can be used. In this configuration, the ink cartridge which can be charged with ink corresponds to any of an ink cartridge and an ink tank of claims.

H6. Modification Example 6

In each embodiment excepting the fifth embodiment, ink is directly supplied to the print head unit 30 from the ink cartridge 12 or 12*a* or the ink tank 90. However, the invention is not limited thereto. A configuration can be used in which a sub tank is provided between the ink cartridge 12 or 12*a*, the ink tank 90, and the print head unit 30, and in which ink is supplied to the print head unit 30 while the amount of flow is adjusted. In addition, in the fifth embodiment, ink is directly supplied from the ink cartridge 12 to the heat exchange unit 51. However, like the above-described configuration, a configuration can be used in which a sub tank is provided between the ink cartridge 12 and the heat exchange unit 51 and ink is supplied to the heat exchange unit 51 via the sub tank.

H7. Modification Example 7

In the above embodiments, a part of a configuration which is implemented by software may be replaced with hardware. In addition, conversely, a part of a configuration which is implemented by hardware may be replaced with software.

H8. Modification Example 8

Among the components of the above-described illustrative embodiments, the embodiments, and the modification examples, elements excepting elements disclosed in independent claims are additional elements, and the appropriate omissions or combinations thereof are possible.

The entire disclosure of Japanese Patent Application No. 2012-021189, filed Feb. 2, 2012 is expressly incorporated by reference herein.

What is claimed is:

1. A printing apparatus comprising:

an ink storage unit;

a print head unit that includes an ink reception port which receives ink supplied from the ink storage unit, an ink storage chamber in communication with the ink reception port to thereby receive the ink from the ink reception port, an ink discharging device which performs ink discharge on a printing medium using a first portion of the supplied ink stored in the ink storage chamber, and an ink exhaust port which exhausts a second portion of the ink from the ink storage chamber which is not used for the ink discharge among the supplied ink;

an ink return path that is connected to the ink exhaust port, and returns the ink which is exhausted from the ink exhaust port to the ink storage unit; and a cooling device that is arranged in the ink return path, and cools ink which passes through the ink return path.

2. The printing apparatus according to claim 1, further comprising:

an installation unit that enables an ink cartridge to be detachably installed, wherein the ink storage unit includes the ink cartridge which is installed in the installation unit.

3. The printing apparatus according to claim 1, further comprising:

a cooling controller that controls a degree of cooling of ink of the cooling device.

4. The printing apparatus according to claim 3, further comprising:

a speed setting value acquisition unit that acquires a setting value of a print speed of the printing apparatus, wherein the cooling controller controls the degree of cooling of the ink of the cooling device depending on the print speed which is indicated by the acquired set value.

5. The printing apparatus according to claim 4, wherein the cooling controller performs control such that the degree of cooling in a case in which the print speed is higher than a predetermined speed is higher than a degree of cooling in a case in which the print speed is equal to or lower than the predetermined speed.

6. The printing apparatus according to claim 3, further comprising:

a resolution setting value acquisition unit that acquires a setting value of a print resolution of the printing apparatus, wherein the cooling controller controls the degree of cooling of the ink of the cooling device depending on the print resolution which is indicated by the acquired setting value.

7. The printing apparatus according to claim 6, wherein the cooling controller performs control such that the degree of cooling in a case in which the print resolution is higher than a predetermined resolution is higher than the degree of cooling in a case in which the print resolution is equal to or lower than the predetermined resolution.

8. The printing apparatus according to claim 3, further comprising:

a temperature measurement unit that measures a temperature of the printing apparatus, wherein the cooling controller controls the degree of cooling of the ink of the cooling device depending on the measured temperature.

9. The printing apparatus according to claim 8, wherein the cooling controller performs control such that the degree of cooling in a case in which the temperature is higher than a predetermined temperature is higher than the degree of cooling in a case in which the temperature is equal to or lower than the predetermined temperature.

10. The printing apparatus according to claim 3, wherein the degree of cooling relates to an amount of electric power which is supplied to the cooling device, and wherein the cooling controller performs control such that the degree of cooling becomes high by increasing the amount of electric power.

11. A method of suppressing rise in temperature of an ink storage unit in a printing apparatus that includes the ink storage unit, a print head unit which has an ink reception port, an ink storage chamber in communication with the ink reception port, an ink exhaust port, and an ink discharging device performing ink discharge on a printing medium, and an ink return path which connects the ink exhaust port with the ink storage unit, the method comprising:

(a) receiving the ink at the ink storage chamber, which is supplied from the ink storage unit, from the ink reception port in the print head unit (b) exhausting a second portion of the received ink from the storage chamber, which is not part of a first portion of the received ink from the storage chamber used for the ink discharge, from the ink exhaust port to the ink return path in the print head unit;

(c) cooling the second portion of the received ink which is exhausted to the ink return path using a cooling device which is arranged in the ink return path; and (d) returning the cooled second portion of the received ink to the ink storage unit using the ink return path.

* * * * *